173-170

10/22/85 OR 4,548,279 SR

United States Patent [19]

Zaruba

[11] Patent Number: 4,548,279

[45] Date of Patent: Oct. 22, 1985

[54] TOOL EXTRACTOR

[76] Inventor: Wenzel Zaruba, 20 Battleridge Trail, Totowa, N.J. 07512

[21] Appl. No.: 518,694

[22] Filed: Jul. 29, 1983

[51] Int. Cl.[4] ..... B27C 3/08

[52] U.S. Cl. ..... 173/170; 173/112; 173/31

[58] Field of Search ..... 173/19, 29, 36, 34, 173/47, 48, 112, 170, 31, 168, 169, 32; 125/36, 40; 254/18, 93 R, 30

[56] References Cited

U.S. PATENT DOCUMENTS 2,622,562 12/1952 Langenecker ..... 173/112
2,776,653 1/1957 Eaton ..... 173/170 X

*Primary Examiner*—Donald R. Schran
*Assistant Examiner*—James Wolfe
*Attorney, Agent, or Firm*—Laughlin and Markensohn

[57] ABSTRACT

A demolition tool is provided with an extractor for removing the chisel or drill from the working surface. The extractor is a piston equipped with a foot which maintains contact with the work surface. When the tool is to be extracted the piston is actuated to press down on the working surface causing the chisel or drill to be forced upward.

9 Claims, 9 Drawing Figures

FIG. 4
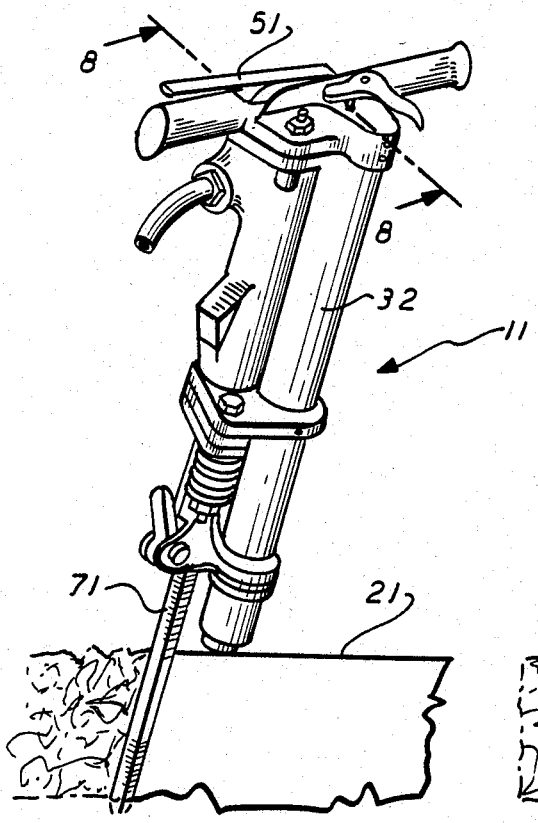
FIG. 5
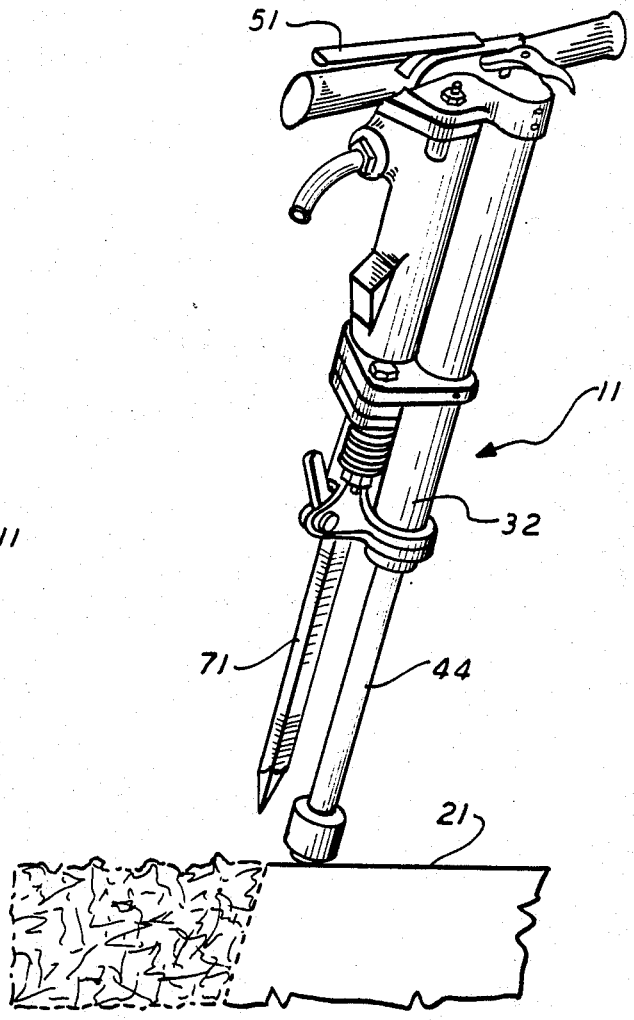
FIG. 6
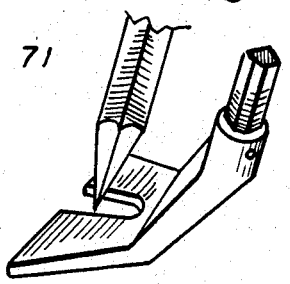
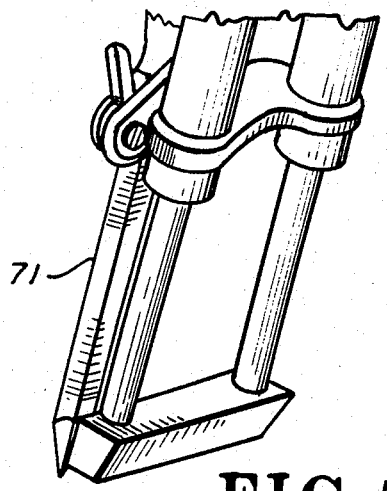
FIG. 7

TOOL EXTRACTOR

BACKGROUND OF THE INVENTION

This invention relates to an apparatus for use with a demolition tool or paving breaker commonly referred to as a jack hammer or rock drill.

Demolition tools can be in two forms. One form of the tool is hand held by an individual operator and the other form is when the tool is affixed to a machine such as by assembly on the back of a tractor or similar type of movable carrier In both machines a chisel or drill is driven into the pavement surface or surface to be broken up. Further, the tool is very heavy and difficult to lift. On a number of occasions, the drill becomes lodged in the pavement and requires a great deal of effort to remove. This results when the tool is hand held as well as machine held. Attempts have been made to overcome this problem by designing the shape of the drills or chisels to allow ease of removal and also devising complex equipment.

OBJECTS OF THE INVENTION

It is an object of the invention to provide a demolition tool with automatic or semi-automatic extraction means. Another object of the invention is to provide such an apparatus which is readily adopted to existing equipment. A further object of the invention is to provide a means for extracting a chisel which becomes embedded in the pavement which can be utilized by a single operator. Other objects and the advantages of the invention will appear from the following detailed description.

SUMMARY OF THE INVENTION

This invention is a combination of a demolition tool and a extractor for removing the chisel or drill from the working surface. The extractor can be operated either automatically or semi automatically. The extractor comprises a sleeve connected and substantially parallel contiguous relation with the body of the demolition tool. A piston is connected to move in an up and down relationship in the sleeve. A piston rod is connected to the piston for pressing against the work surface and lifting the demolition tool when desired and with the demolition tool disposed in an operated relationship to a working surface. A system is provided for supplying an actuating force such as compressed air to and from the piston. The air flow is actuated by a valve to cause the piston to extend thereby causing the raising of the demolition tool from the work surface.

In operation, the demolition tool is utilized to break up pavement or the like and the chisel or drill on the end of the demolition tool passes into the pavement or working surface by a series of pulsations. When it is desired to extract the chisel completely from the working surface, the tool extraction mechanism is actuated automatically or semi automatically by opening a valve to force the piston foot against the pavement and thereby raise the chisel away from and out of engagement with the pavement. This permits a simple and expeditious way to remove a chisel or drill from pavement without undue exertion on the operator or machine.

DESCRIPTION OF THE DRAWINGS

FIG. 4 is similar to FIG. 2 except that it shows the extractor in the released or raised position.

FIG. 5 is a perspective view of a type of foot which can be utilized on the extractor.

FIG. 6 is a view of another type of foot which can be utilized on the extractor.

Figure 1:
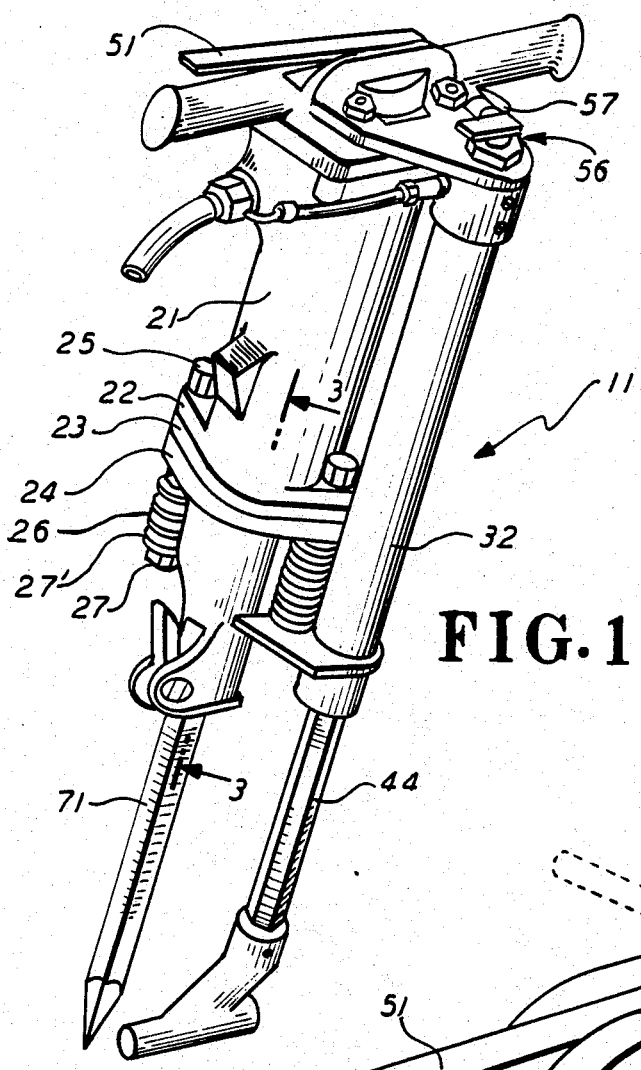
FIG. 1 is a perspective view of a conventional paving breaker equipped with an extractor mounted on its side.

FIGS. *7a* and *7b* are perspective views partly in sections showing the top and bottom portions of the mechanism of the extractor.

DETAILED DESCRIPTION OF THE INVENTION

Referring to the drawings in the conventional hand held demolition tool, generally indicated at 11, the operator holds the tool in an approximately vertical position. The operation is started by the operator depressing a valve handle 51 to open the throttle valve 52 which allows air to flow to a case valve 15 which opens the air to the top cylinder chamber 16 and the compressed air will force the piston 17 down the cylinder passage 18. The piston 17 in its downward motion will strike a block anvil 19 which in turn will strike a chisel or drill 71 which is being utilized to break up the pavement or similar surface 21. When the pressure drops down, air is exhausted and the valve 15 shifts the air pressure to force the piston 17 to the upper position. When the piston reaches the upper position, the valve 15 automatically reverses itself opening air flow to the top cylinder chamber 18 and the piston is forced down the cylinder to strike the block anvil 19 and the chisel 71 again. This sequence is repeated over and over so long as the operator holds the air inlet valve open. The chisel or drill are driven into the ground or black top or cement to be broken up. During such operations, it is not uncommon for the chisel 71 to become embedded in the pavement 21 making it extremely difficult to remove. This coupled with the weight of the apparatus is a demanding task resulting in operator fatigue. The operator is able to operate the equipment for only a limited time because of these difficulties.

Figure 3:
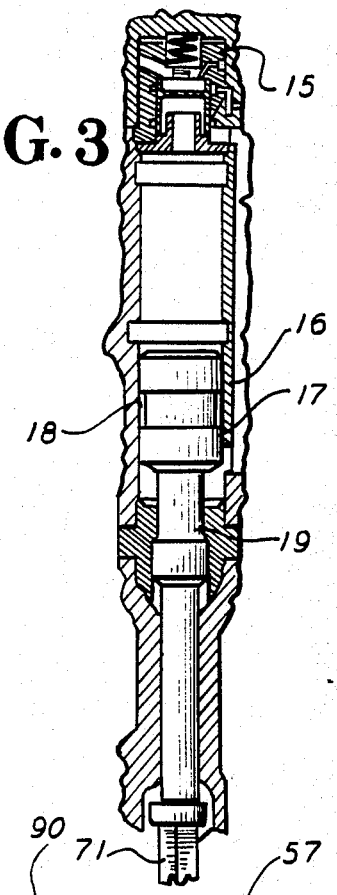
FIG. 3 is a perspective view of a paving breaker with the extractor as an intergral part of the breaker.

The extractor of the invention can be a permanent part of the demolition tool as shown in FIG. 3, or it can be formed as an attachment for existing tools as shown in FIG. 1. The extractor comprises a cylinder body 32 which has a side air inlet opening 26 and also houses a piston 40 and piston rod 44. The cylinder is affixed at its top and at a mid point to the cylinder body 21 of the breaking tool. The lower part of the cylinder body 22 is provided with two hole flange 22 through which fasteners such as bolts 25 pass for securing the extractor to the main cylinder 21. A bushing 23 is under the flange 22 and of the same configuration. Below the bushing 23 is the front head 24 which is also flanged. These three flanged parts are held together with fasteners such as bolts 47. It is desired to assure a certain flexibility to the assembly and this is accomplished with a spring arrangement 26 which is secured to the end of the bolts 25 by a washer 27' and nut 27. The lower part of the front head 24 has a partly cylindrical extention 28. This extention 28 is provided with a bore 29 with a rubber gromet 30 inserted in the bore to insulate vibration of the front head 24 from the extractor cylinder 32. The extractor is secured in place to the pavement breaker by a clamp member 33. In order to secure the extractor cylinder 32 in a predetermined position, the outer part of the cylinder is provided with the keyway cut out 34 and a fastener 35 is the key. The bottom end of this extractor cylinder 32 has a bearing bushing 36 threaded in the cylinder 32. A cylindrical cavity 37 contains a mud scraper 38 which is pressed into cavity 37 for cleaning the piston rod 44. The upper part of the extractor cylinder 32 is slidably mounted in part of the cylindrical extension 20. It is also provided with an "O" ring 39 to assure air tightness.

Figure 2:
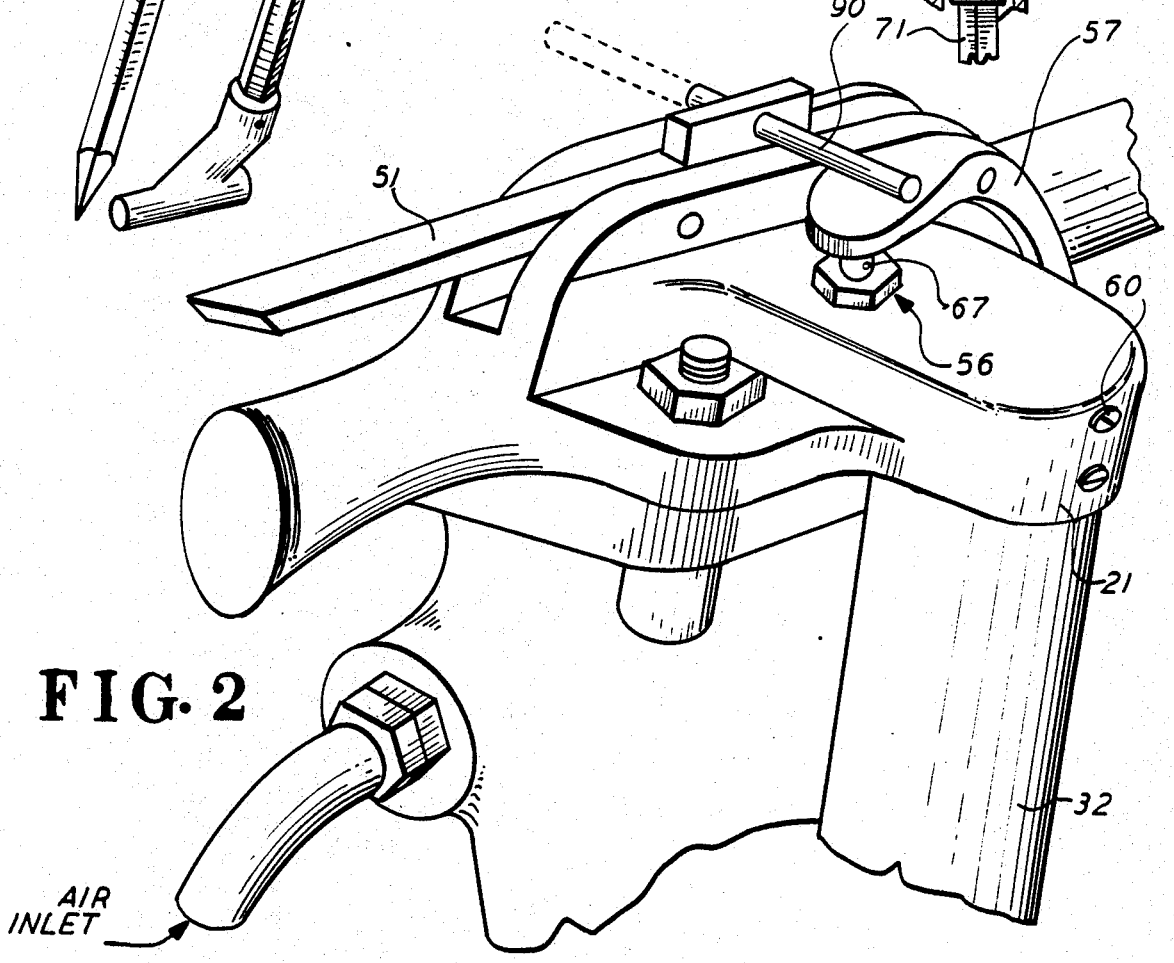
FIG. 2 is a perspective view of the upper portion of the extractor shown in FIG. 1.
Figure 8A:
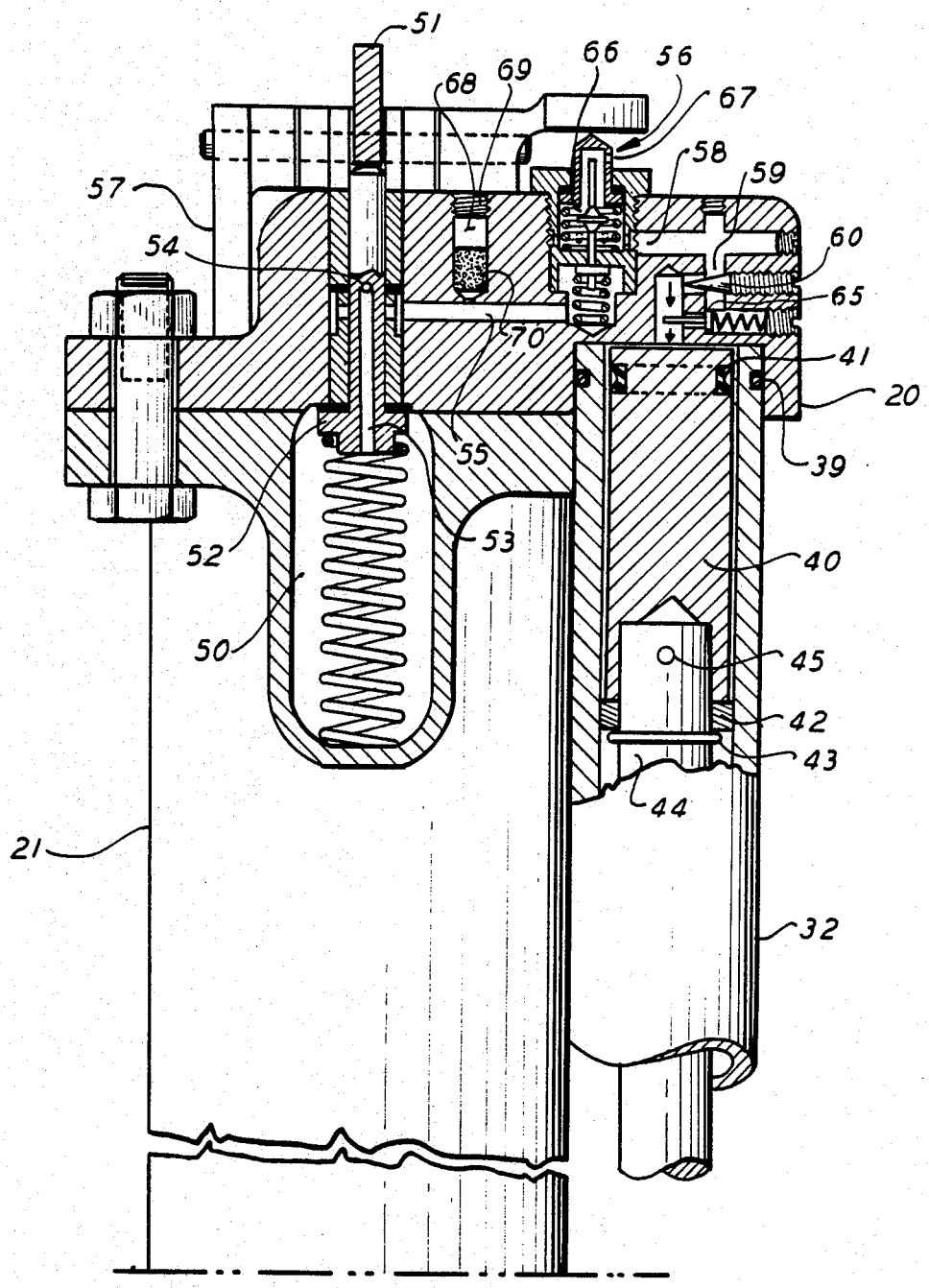
Figure 8B:
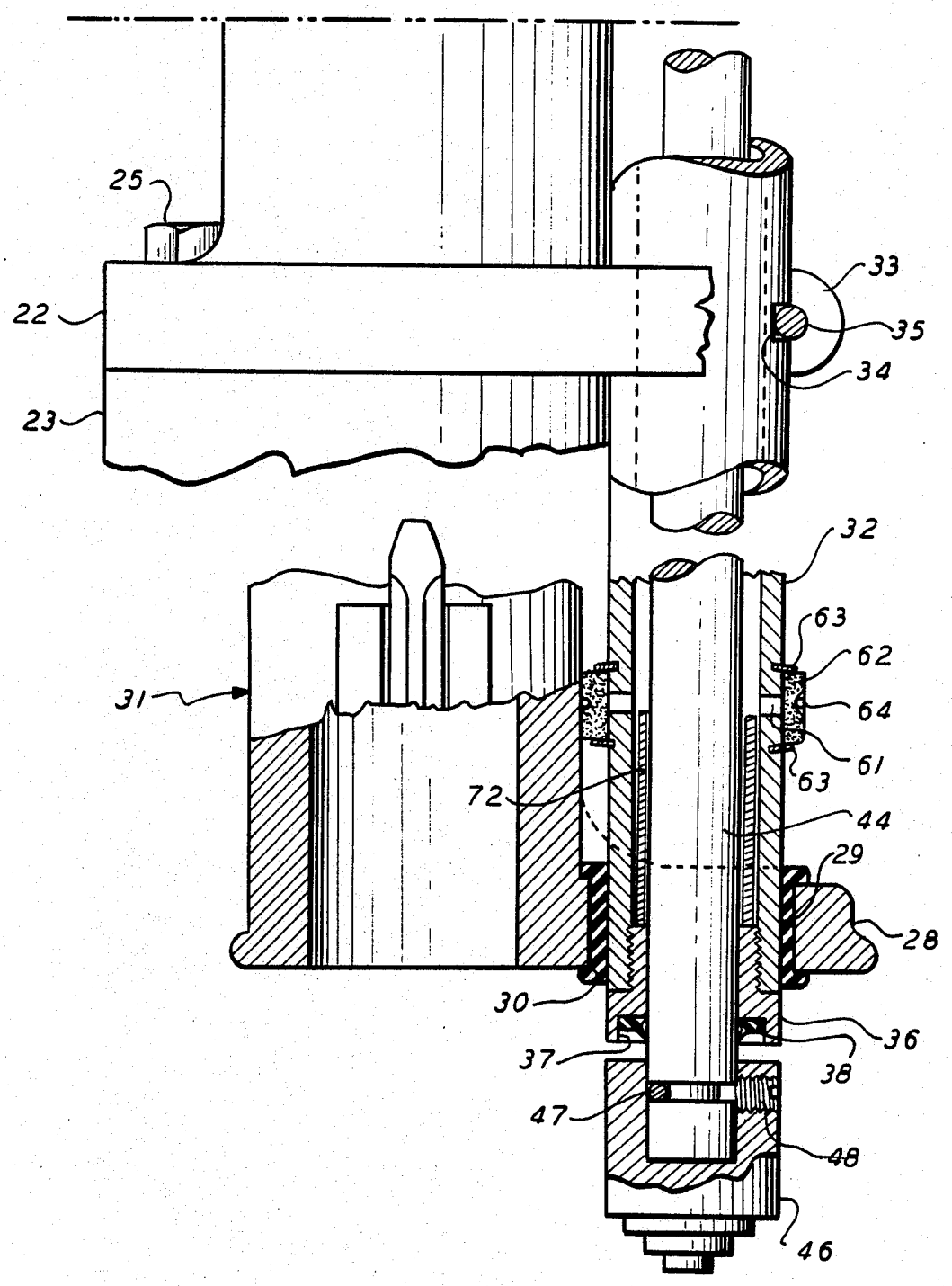

The upper part the piston 43 is provided with a lip seal 41. The lower part is provided with a wear ring 42. This ring 42 is held in place by a retaining ring 43 and the piston rod 44. The piston rod 44 is secured to the piston 40 by a pin 45. The lowest part of the piston rod 44 is provided with a foot 46 which can be in a number of different shapes as shown in FIGS. 2, 4 and 5. The footing is held to the piston rod by a pin or set screw 48.

In order for the extractor to be operated, it is necessary to have sufficient air supply. The air is supplied to operate the pavement breaker by a flexible hose which is connected to a swivel air inlet pipe 49. The compressed air is usually of a pressure of about 90 psi which enters into the cavity 50. A pin is provided so sliding through a bracket on handle 51 can be operated in an automatic or semi-automatic manner by the operator moving the pin. In the automatic position, the pin is slid so that when handle 51 is not depressed, the pin is depressing handle 57 to open the valve on the extractor.

In order to operate the paving breaker, the operator presses the lever 51 which causes the plunger valve 51 to open the air flow to the paving breaker mechanism and operation starts. The extractor mechanism is provided with a steady flow of air at all the times. The steady flow of air from the cavity 50 will go through the cylindrical openings 53 provided in the stem valve 52 and through cross drilled holes 54 through cylindrical openings to the three way valve assembly 56. In order to extract the paving breaker from the ground, the operator depresses the valve lever 57 on the three way valve 56 which opens the air flow to the piston 40. Air will flow to piston 40 following passages 58 and 59, through the flow control valve 60 to the piston 40. The piston 40 is connected to the piston rod 44 and to the shoe or foot 46 which is always touching the ground. It will perform the task of pulling the paving breaker out of the ground. When the piston 40 is forced down the cylinder tube 32, the air from the lower part of the cylinder is forced out through the exhaust opening 61. This opening is covered with porous filter material held in place by retaining links 63 and spring clip 64. This allows frequent cleaning. This filter is provided to prevent dust from entering the cylinder cavity.

The air flow control 60 is adjustable for faster or slower function. When the extraction is complete, the operator will release the valve which closes the air flow and opens the air exhaust. While the operator is driving the paving breaker chisel 71 into the ground, the extractor piston and rod is telescoping into the cylinder with the foot always touching the ground. The air is slowly exhausted through the check valve 65, air passages 58, 59 and open port 66 and out into the atmosphere through opening 67. When the piston is pressing all air through the exhaust of the three way valve 56, air is slowly sucked through the exhaust opening 61 guarded by filter ring 62. In order to assure proper operating order of the extractor, oil cavity 68 is provided to oil all moving parts. A plug 69 closes the oil cavity felt sling 70 for oil saturation cylinder spacer 72.

Although the invention is described in reference to an air operated demolition tool, other types can be utilized such as electronic forces i.e. magnets.

Although this invention has been described in relation to one particular embodiment, it would be obvious to those skilled in the art of various alternative apparatus and arrangements which can be used without departing from the spirit and scope of the invention.

What is claimed is:

1. In a demolition tool of the type in which compressed air or other force is utilized to cause a chisel or cutting device to enter a working surface with an extraction device mounted on the demolition tool to aid in removal of the chisel from the working surface comprising a pneumatic piston cylinder and rod, the improvement which comprises means for supplying a continual source of compressed air to the pneumatic piston cylinder, means for selectively allowing the compressed air to enter the extractor piston cylinder to maintain the rod in contact with the work surface, means for controlling the incoming flow of compressed air to the pneumatic piston cylinder to force the rod against the work surface and extracting the chisel from the work surface, means for allowing air to be released from the pneumatic piston cylinder to allow the chisel to enter the working surface while the rod maintains contact with the working surface, and wherein the upper portion of the extractor piston-cylinder is slidably mounted in a cylindrical extension from the top of the demolition tool, the lower portion of the extractor cylinder is mounted to a second cylindrical extension at the lower end of the demolition tool in a vibration insulating manner, and a clamp portion of the demolition tool secures the extractor cylinder demountably attached in an adjusted position by the use of a keyway cut in the extractor cylinder with a fastener for the clamp acting as the key.

2. The improved demolition tool as recited in claim 1, wherein the compressed air is provided from that used to power the demolition tool by the compressed air passing through a cylindrical passage in a valve stem of a valve which actuates the demolition tool and then through a cross-drilled passage leading to the means for selectively providing compressed air to the extractor piston.

3. The improved demolition tool as recited in claim 2, wherein the means for selectively providing compressed air to the extractor piston-cylinder comprises:

(a) a three-way valve assembly and (b) a lever which selectively activates the three-way valve allowing the compressed air to pass from the tool to the extractor cylinder.

4. The improved demolition tool as recited in claim 3, wherein the means for controlling the flow of compressed air to the extractor cylinder is a valve located interferingly with the flow of compressed air from the three-way valve to the extractor cylinder.

5. An improved demolition tool as recited in claim 4, wherein the means for allowing air to be exhausted from the extractor cylinder as the extractor piston is forced back comprises:

(a) a check valve for allowing air to pass through at an adjusted rate and (b) a poppet in the three-way valve allowing the air from the check valve to be released to the atmosphere via an opening in the three ways valve.

6. The improved demolition tool as recited in claim 5, which comprises a shoe shaped foot affixed to the piston rod so that the shoe rests on the working surface.

7. The demolition tool as recited in claim 1 which includes a first sleeve, a first piston disposed to move slidably in said first sleeve, an anvil interposed in a position to be impinged on by said first piston, an operating lever, valve means, a source of compressed air and a system of conduits connected in relation to drive said first piston up an down relation in said first sleeve in response to operation of said lever, operating said valve means the extraction device comprising in combination a second sleeve connected in substantially parallel contiguous relation with saif first sleeve, a second piston connected to move in an up and down relationship in said second sleeve, a piston rod connected to said second piston for lifting said demolition tool when said demolition tool is deposed in operated relation to a working surface, a system of conduits including means for delivering said compressed air from said first sleeve to said second sleeve and a second valve system and actuating means connected to operate said second valve system to deliver compressed air to said second sleeve for moving said second piston in a downward direction to impinge on said work area thereby to raise the demolition tool out of said work area.

8. The demolition tool as recited in claim 1, which includes a control means for allowing the extractor device to operate in an automatic mode when in one position which extracts the chisel from the work surface when the operator stops the action of the demolition tool chisel and in the second position will allow the operator to control independently the action of the extractor device and the demolition tool.

9. The improved demolition tool as recited in claim 1 further comprising an oil cavity for coiling the moving parts including a felt sling to provide oil to an oil saturation spacer.

* * * * *

UNITED STATES PATENT AND TRADEMARK OFFICE

CERTIFICATE OF CORRECTION

PATENT NO. : 4,548,279

DATED : October 22, 1985

INVENTOR(S) : Wenzel Zaruba

It is certified that error appears in the above-identified patent and that said Letters Patent is hereby corrected as shown below:

Column 5, line 19, "saif" should read --said--

Column 6, line 20, "coiling" should read --oiling--

Signed and Sealed this

*Fourteenth* Day of *January 1986*

[SEAL]

*Attest:*

*Attesting Officer*

DONALD J. QUIGG

*Commissioner of Patents and Trademarks*